US008915369B2

(12) United States Patent
Kuo et al.

(10) Patent No.: US 8,915,369 B2
(45) **Date of Patent: *Dec. 23, 2014**

(54) JOINTED LIQUID CRYSTAL GLASS PANEL PACKAGE BOX

(71) Applicant: Shenzhen China Star Optoelectronics Technology Co., Ltd., Shenzhen (CN)

(72) Inventors: Yicheng Kuo, Shenzhen (CN); Shihhsiang Chen, Shenzhen (CN); Jiahe Cheng, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/704,240

(22) PCT Filed: Oct. 19, 2012

(86) PCT No.: PCT/CN2012/083167

§ 371 (c)(1), (2), (4) Date: Dec. 13, 2012

(87) PCT Pub. No.: WO2014/047989

PCT Pub. Date: Apr. 3, 2014

(65) Prior Publication Data

US 2014/0091000 A1 Apr. 3, 2014

(51) Int. Cl.

| | |
|---|---|
| ***B65D 85/48*** | (2006.01) |
| ***B65D 6/24*** | (2006.01) |
| ***B65D 81/18*** | (2006.01) |

(52) U.S. Cl.

CPC ..... *B65D 85/48* (2013.01); *B65D 11/1873* (2013.01); *B65D 81/18* (2013.01)

USPC ..... 206/454; 206/724; 206/455; 220/4.33

(58) Field of Classification Search

USPC ..... 206/454, 724, 455; 220/4.33, 4.28, 647, 220/668, 681, 682, 683, 685

See application file for complete search history.

(56) References Cited

U.S. PATENT DOCUMENTS 3,150,903 A * 9/1964 Chapman et al. ..... 312/265.4
3,784,043 A * 1/1974 Presnick ..... 220/4.28

(Continued)

FOREIGN PATENT DOCUMENTS

CN 2682009 Y 3/2005
CN 201132624 Y 10/2008

(Continued)

*Primary Examiner* — Anthony Stashick
*Assistant Examiner* — James Way
(74) *Attorney, Agent, or Firm* — Cheng-Ju Chiang

(57) ABSTRACT

The present invention provides a jointed liquid crystal glass panel package box, which includes a box body and a plurality of brackets mounted to the box body. The box body includes a frame and a hollow plate arranged inside the frame. The frame includes two opposite first frame members, two opposite second frame members, and four L-shaped connection members connecting between the first frame members and the second frame members. The first and second frame members are of a linear configuration. Each first frame member includes a plurality of first frame member units and a plurality of first couplers each connecting between two first frame member units. Each second frame member includes a plurality of second frame member units and a plurality of second couplers each connecting between two second frame member units. A plurality of water-resistant pads is arranged between the first couplers and the first frame member units.

8 Claims, 6 Drawing Sheets

(56) References Cited

U.S. PATENT DOCUMENTS

| | | | | |
|---|---|---|---|---|
| 5,765,707 | A * | 6/1998 | Kenevan | 220/4.28 |
| 5,797,514 | A * | 8/1998 | Twiggar et al. | 220/683 |
| 2014/0083893 | A1 * | 3/2014 | Kuo et al. | 206/454 |

FOREIGN PATENT DOCUMENTS

| | | | |
|---|---|---|---|
| CN | 201745949 | U | 2/2011 |
| CN | 202072065 | U | 12/2011 |
| EP | 0235341 | A2 | 9/1987 |

* cited by examiner

JOINTED LIQUID CRYSTAL GLASS PANEL PACKAGE BOX

BACKGROUND OF THE INVENTION

1. Field of the Invention

The present invention relates to the field of packaging, and in particular to a jointed liquid crystal glass panel package box.

2. The Related Arts

In the field of manufacture of liquid crystal display devices, the manufacture of liquid crystal display devices includes a process of assembling, which puts various components, including a liquid crystal glass panel, a main control circuit, and an enclosure, together. These components are each manufactured in advance and packaged for being later assembled to form a complete liquid crystal display device. The liquid crystal glass panel, after being manufactured, is packaged in a liquid crystal glass panel package box and then shipped in box to a corresponding assembling station. Commonly used package boxes include paper boxes and plastic boxes.

A conventional liquid crystal glass panel packaging structure is illustrated in FIG. 1, which comprises a lower case 100 and an upper case (not shown) that are coupleable to each other. A plurality of cushioning blocks 500 is provided inside the lower case 100 corresponding to edges of a liquid crystal glass panel 300. The lower case 100 comprises a mounting section 102 and the cushioning members 500 have one side that is fixed to the mounting section 102 by a double-sided adhesive tape. The lower case 100 also forms a recess 104 corresponding to a lower end of the cushioning member 500 so that the lower end of the cushioning member 500 is mounted in the recess 104. To package, liquid crystal glass panels 300 are sequentially stacked inside the lower case.

With the diversification of the specification of the liquid crystal display device products, the liquid crystal glass panels are subjected to corresponding changes. The conventional method for manufacturing liquid crystal glass panel is no longer satisfactory. Thus, it needs to make various molds to meet the needs of liquid crystal glass panels of various sizes. However, this way is not an ultimate solution to the problem and the expenditure of development is high and development cycle is long.

Thus, it is a challenge to the present inventor and those devoted themselves to the art to provide a liquid crystal glass panel package box that can show various sizes and has excellent package performance and also overcomes the problems of occupying a large amount of space in storage and having a high cost of transportation.

SUMMARY OF THE INVENTION

An object of the present invention is to provide a jointed liquid crystal glass panel package box, which is made up of a jointed frame and hollow plates, allowing the size to be adjustable to extend the application thereof, and is also effective in resisting humidity by arranging water-resistant pads between connection units and couplers.

To achieve the object, the present invention provides a jointed liquid crystal glass panel package box, which comprises a box body and a plurality of brackets mounted to the box body. The box body comprises a frame and a hollow plate arranged inside the frame. The frame comprises two opposite first frame members, two opposite second frame members, and four L-shaped connection members connecting between the first frame members and the second frame members. The first and second frame members are of a linear configuration.

Each of the first frame members comprises a plurality of first frame member units and a plurality of first couplers each connecting between two first frame member units. Each of the second frame members comprises a plurality of second frame member units and a plurality of second couplers each connecting between two second frame member units. A plurality of water-resistant pads is arranged between the first couplers and the first frame member units and between the second couplers and the second frame member units.

Each of the first frame member units has one end forming a first mounting section and an opposite end forming a second mounting section. Each of the second frame member units has an end forming a third mounting section and an opposite end forming a fourth mounting section. The first coupler has an end forming a first mounting slot and an opposite end forming a second mounting slot. The first mounting section is received and retained in the first mounting slot and the second mounting section is received and retained in the second mounting slot to form the first frame member. The two ends of the first frame member are respectively a first mounting section and a second mounting section. The second coupler has an end forming a third mounting slot and an opposite end forming a fourth mounting slot. The third mounting section is received and retained in the third mounting slot and the fourth mounting section is received and retained in the fourth mounting slot to form the second frame member. The two ends of the second frame member are respectively a third mounting section and a fourth mounting section.

The plurality of water-resistant pads are arranged between the first mounting sections and the first mounting slots, between the second mounting sections and the second mounting slots, between the third mounting sections and the third mounting slots, and between the fourth mounting sections and the fourth mounting slots.

The water-resistant pad arranged between the first mounting section and the first mounting slot is of a configuration identical to that of the first mounting slot. The water-resistant pad arranged between the second mounting section and the second mounting slot is of a configuration identical to that of the second mounting slot. The water-resistant pad arranged between the third mounting section and the third mounting slot is of a configuration identical to that of the third mounting slot. The water-resistant pad arranged between the fourth mounting section and the fourth mounting slot is of a configuration identical to that of the fourth mounting slot.

The water-resistant pads are of a plate like structure and are arranged, in group, between the first mounting section and the first mounting slot, between the second mounting section and the second mounting slot, between the third mounting section and the third mounting slot, and between the fourth mounting section and the fourth mounting slot.

The first mounting section and the third mounting section are of the same structure and size and the first mounting slot and the third mounting slot are of the same structure and size. The second mounting section and the fourth mounting section are of the same structure and size. The second mounting slot and the fourth mounting slot are of the same structure and size.

Each of the connection members has an end forming a fifth mounting slot and an opposite end forming a sixth mounting slot. The fifth mounting slot is of the same structure and size as the first mounting slot and the third mounting slot. The sixth mounting slot is of the same structure and size as the second mounting slot and the fourth mounting slot. The fifth mounting slot is provided for selective engagement with the first and third mounting sections. The sixth mounting slot is provided for engagement with the second and fourth mounting sections to thereby form the frame.

The first frame member units, the first coupler, the second frame member units, the second coupler, and the connection members are made of plastic injection molding. The water-resistant pads are made of rubber or silicon gel.

The bracket comprises two first reinforcement plates, two second reinforcement plates, and a third reinforcement plate. The first and second reinforcement plates respectively correspond to the first and second frame members to show a linear configuration. The third reinforcement plate is of a cruciform configuration. The first reinforcement plates are mounted to an end of the first frame members that is adjacent to the hollow plate. The second reinforcement plates are mounted to an end of the second frame members that is adjacent to the hollow plate. The third reinforcement plate has four ends respectively mounted to the ends of the two first reinforcement plates and the two second reinforcement plates that are adjacent to the hollow plate.

The first reinforcement plates, the second reinforcement plates, and the third reinforcement plate are all ferrous plates. The first reinforcement plates, the second reinforcement plates, and the third reinforcement plate are connected to each other through riveting or threading engagement to form the bracket.

The present invention also provides a jointed liquid crystal glass panel package box, which comprises a box body and a plurality of brackets mounted to the box body, the box body comprising a frame and a hollow plate arranged inside the frame, the frame comprising two opposite first frame members, two opposite second frame members, and four L-shaped connection members connecting between the first frame members and the second frame members, the first and second frame members being of a linear configuration, each of the first frame members comprising a plurality of first frame member units and a plurality of first couplers each connecting between two first frame member units, each of the second frame members comprising a plurality of second frame member units and a plurality of second couplers each connecting between two second frame member units, a plurality of water-resistant pads being arranged between the first couplers and the first frame member units and between the second couplers and the second frame member units;

wherein each of the first frame member units has one end forming a first mounting section and an opposite end forming a second mounting section, each of the second frame member units having an end forming a third mounting section and an opposite end forming a fourth mounting section, the first coupler having an end forming a first mounting slot and an opposite end forming a second mounting slot, the first mounting section being received and retained in the first mounting slot and the second mounting section being received and retained in the second mounting slot to form the first frame member, the two ends of the first frame member being respectively a first mounting section and a second mounting section, the second coupler having an end forming a third mounting slot and an opposite end forming a fourth mounting slot, the third mounting section being received and retained in the third mounting slot and the fourth mounting section being received and retained in the fourth mounting slot to form the second frame member, the two ends of the second frame member being respectively a third mounting section and a fourth mounting section;

wherein the plurality of water-resistant pads are arranged between the first mounting sections and the first mounting slots, between the second mounting sections and the second mounting slots, between the third mounting sections and the third mounting slots, and between the fourth mounting sections and the fourth mounting slots;

wherein the water-resistant pad arranged between the first mounting section and the first mounting slot is of a configuration identical to that of the first mounting slot; the water-resistant pad arranged between the second mounting section and the second mounting slot is of a configuration identical to that of the second mounting slot; the water-resistant pad arranged between the third mounting section and the third mounting slot is of a configuration identical to that of the third mounting slot; and the water-resistant pad arranged between the fourth mounting section and the fourth mounting slot is of a configuration identical to that of the fourth mounting slot;

wherein the first mounting section and the third mounting section are of the same structure and size and the first mounting slot and the third mounting slot are of the same structure and size, the second mounting section and the fourth mounting section being of the same structure and size, the second mounting slot and the fourth mounting slot being of the same structure and size;

wherein each of the connection members has an end forming a fifth mounting slot and an opposite end forming a sixth mounting slot, the fifth mounting slot being of the same structure and size as the first mounting slot and the third mounting slot, the sixth mounting slot being of the same structure and size as the second mounting slot and the fourth mounting slot, the fifth mounting slot being provided for selective engagement with the first and third mounting sections, the sixth mounting slot being provided for engagement with the second and fourth mounting sections to thereby form the frame;

wherein the first frame member units, the first coupler, the second frame member units, the second coupler, and the connection members are made of plastic injection molding, the water-resistant pads being made of rubber or silicon gel;

wherein the bracket comprises two first reinforcement plates, two second reinforcement plates, and a third reinforcement plate, the first and second reinforcement plates respectively corresponding to the first and second frame members to show a linear configuration, the third reinforcement plate being of a cruciform configuration, the first reinforcement plates being mounted to an end of the first frame members that is adjacent to the hollow plate, the second reinforcement plates being mounted to an end of the second frame members that is adjacent to the hollow plate, the third reinforcement plate having four ends respectively mounted to the ends of the two first reinforcement plates and the two second reinforcement plates that are adjacent to the hollow plate; and wherein the first reinforcement plates, the second reinforcement plates, and the third reinforcement plate are all ferrous plates, the first reinforcement plates, the second reinforcement plates, and the third reinforcement plate being connected to each other through riveting or threading engagement to form the bracket.

The efficacy of the present invention is that the present invention provides a jointed liquid crystal glass panel package box, which comprises first and second frame members and connection members jointed to form a frame, of which the size is adjustable so as to be applicable to packaging of liquid crystal glass panels of different sizes. Water-resistant pads are arranged between the couplers and t connection units to provide an effective resistance against humidity. A hollow plate is provided as a bottom board to support the liquid crystal glass panels. A bracket is provided to improve the strength so as to prevent liquid crystal glass panels from damage caused by impacts of external forces. Further, the jointed liquid crystal glass panel package box of the present invention has a simple structure and a number of components can be manufactured with the same mold so as to effectively lower down the cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
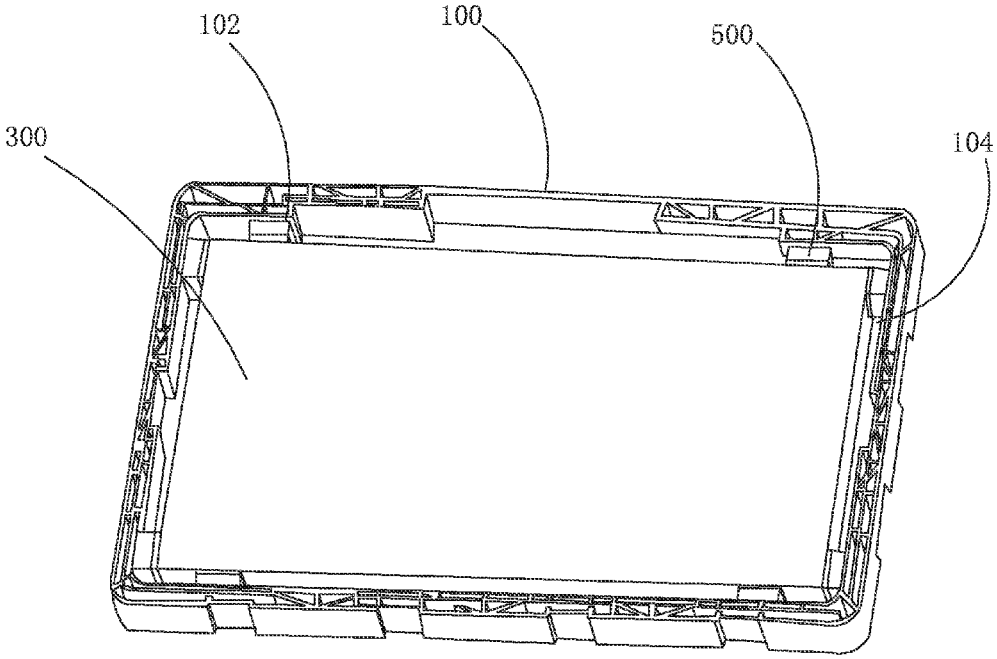
Fig. 1 (Prior Art)
FIG. 1 is a schematic view illustrating a conventional package box of liquid crystal glass panel.
Figure 2:
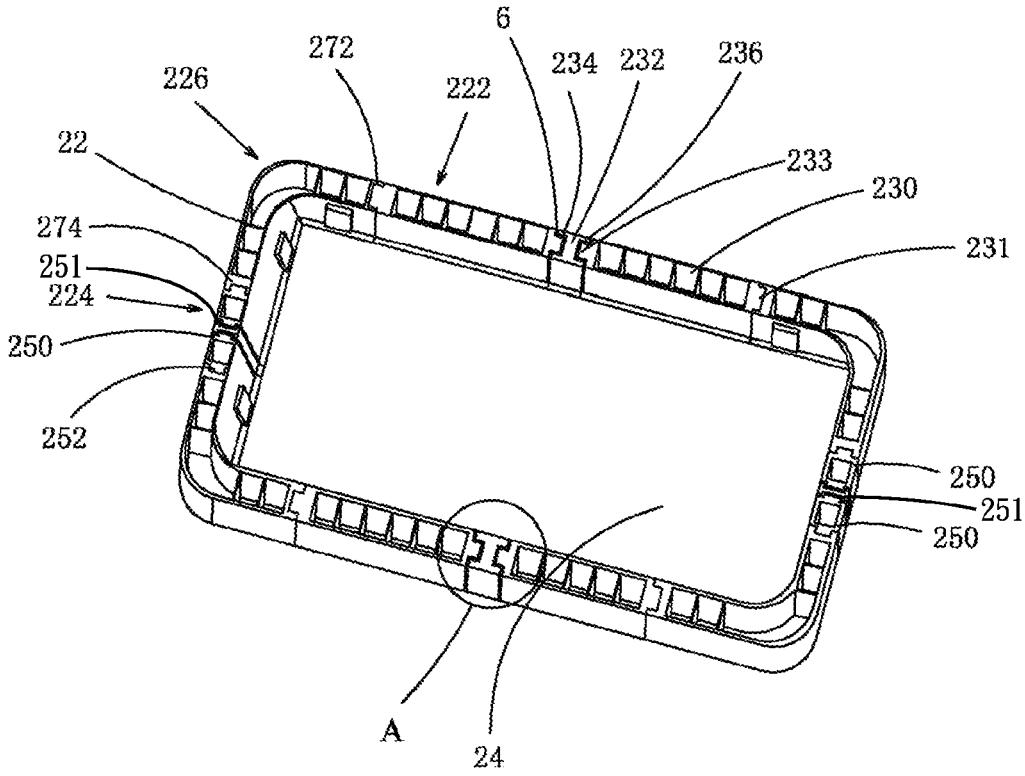
FIG. 2 is a schematic view showing a jointed liquid crystal glass panel package box according to an embodiment of the present invention.
Figure 3:
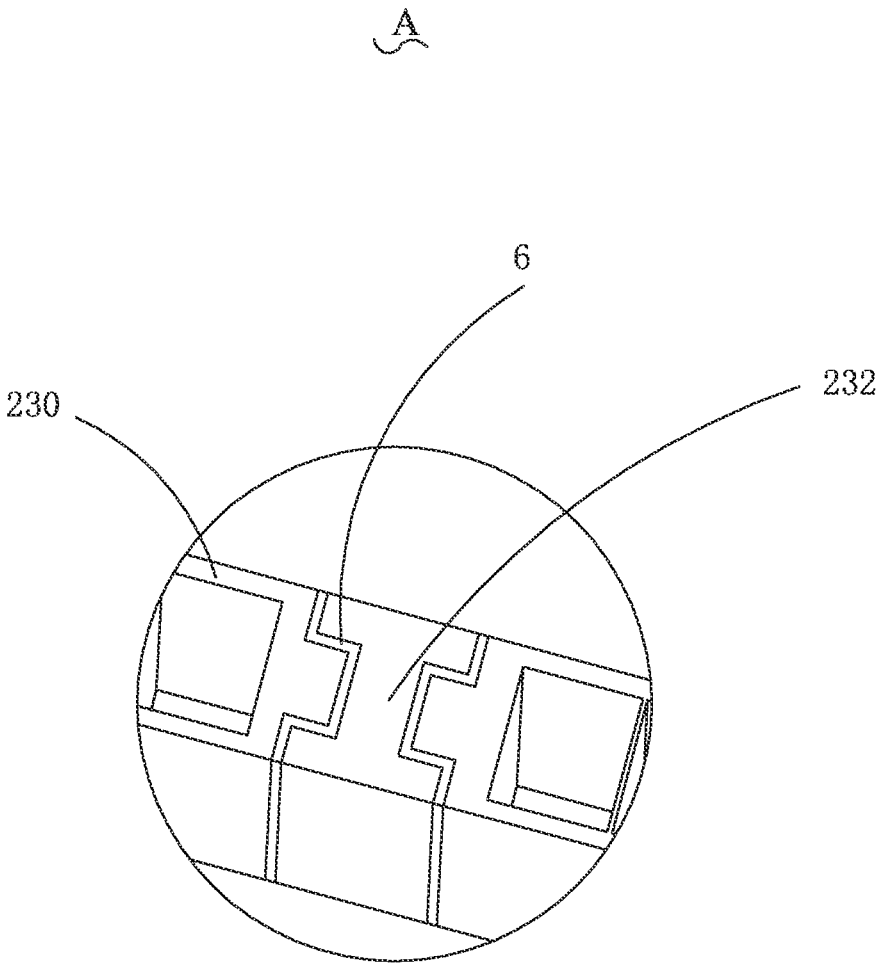
FIG. 3 is an enlarged view of circled portion A of FIG. 2.
Figure 4:
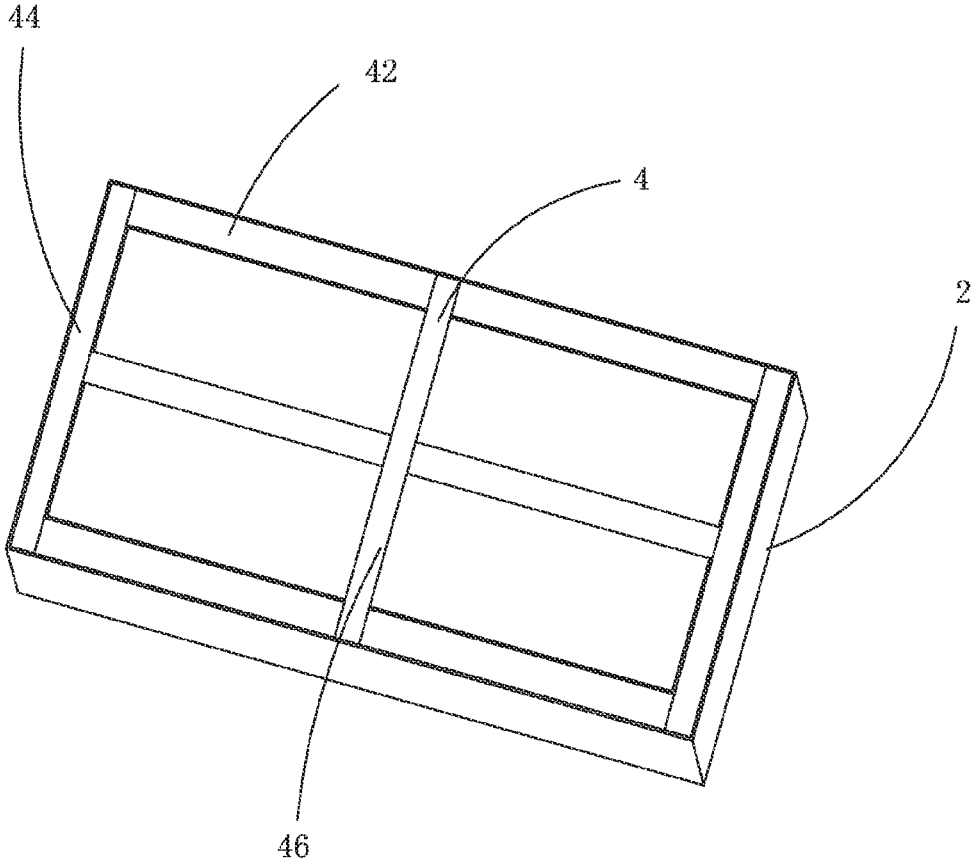
FIG. 4 is a schematic view illustrating mounting positions of brackets of FIG. 2.

Referring to FIGS. 2-4, the present invention provides a jointed liquid crystal glass panel package box, which comprises a box body 2 and a plurality of brackets 4 mounted to the box body 2. The box body 2 comprises a frame 22 and a hollow plate 24 arranged inside the frame 22.

The frame 22 comprises two opposite first frame members 222, two opposite second frame members 224, and four L-shaped connection members 226 connecting between the first frame members 222 and the second frame members 224.

Figure 5:
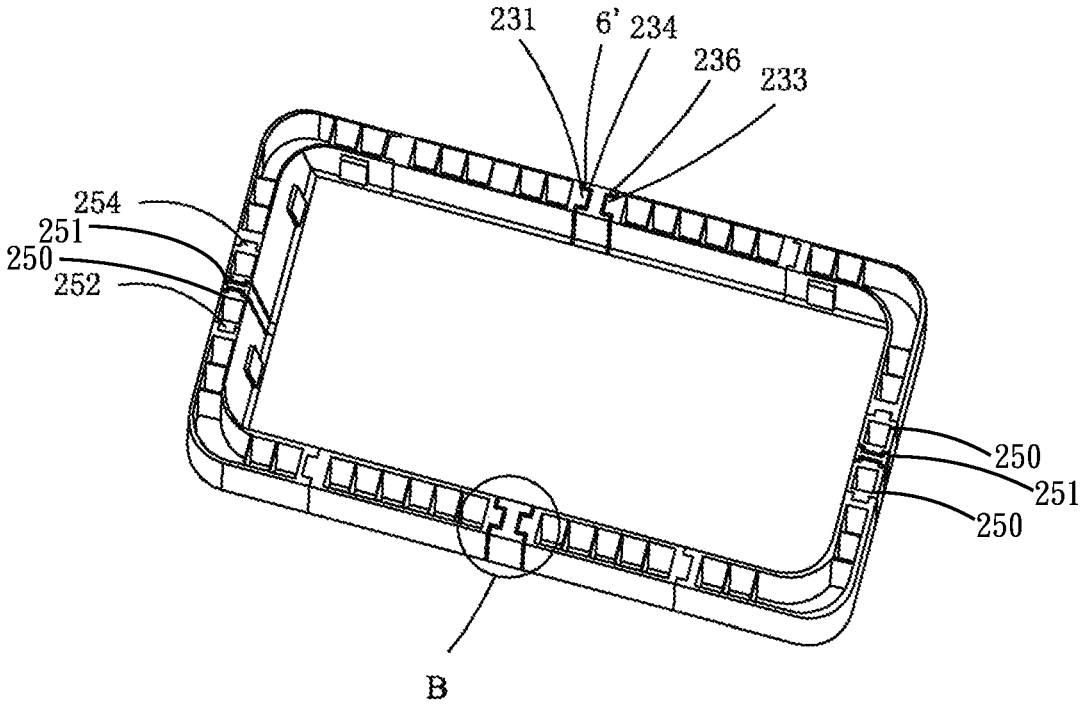
FIG. 5 is a schematic view showing a jointed liquid crystal glass panel package box according to another embodiment of the present invention.

The first and second frame members 222, 224 are all of a linear configuration. Each of the first frame members 222 comprises a plurality of first frame member units 230 and a plurality of first couplers 232 each connecting between two first frame member units 230. Each of the second frame members 224 comprises a plurality of second frame member units 250 and a plurality of second couplers 251 each connecting between two second frame member units 250 as shown in FIGS. 2 and 5. A plurality of water-resistant pads 6 is arranged between the first coupler 232 and the first frame member unit 230 and between the second coupler 251 and the second frame member unit 250 to effectively resist humidity so as to protect the liquid crystal glass panels from damage caused by humidity during the transportation thereof.

Each of the first frame member units 230 has one end forming a first mounting section 231 and an opposite end forming a second mounting section 233. Each of the second frame member units 250 has an end forming a third mounting section 252 and an opposite end forming a fourth mounting section 254. In the instant embodiment, each of the second frame members 224 comprises only one second frame member unit 250, but the number of the second frame member units 250 can be adjusted according to practical needs.

The first coupler 232 has an end forming a first mounting slot 234 and an opposite end forming a second mounting slot 236. The first mounting section 231 is received and retained in the first mounting slot 234 and the second mounting section 233 is received and retained in the second mounting slot 236 to form the first frame member 222. The two ends of the first frame member 222 are respectively a first mounting section 231 and a second mounting section 233. The second coupler 251 has an end forming a third mounting slot and an opposite end forming a fourth mounting slot. The third mounting section 252 is received and retained in the third mounting slot and the fourth mounting section 254 is received and retained in the fourth mounting slot to form the second frame member 224. The two ends of the second frame member 224 are respectively a third mounting section 252 and a fourth mounting section 254.

The water-resistant pads 6 are made of a soft material, such as rubber or silicon gel, and are respectively arranged between the first mounting section 231 and the first mounting slot 234, between the second mounting section 233 and the second mounting slot 236, between the third mounting section 252 and the third mounting slot, and between the fourth mounting section 254 and the fourth mounting slot, whereby when the first, second, third, and fourth mounting sections 231, 233, 252, 254 are mounted to the first mounting slot 234, the second mounting slot 236, the third mounting slot, and the fourth mounting slot with fastening or riveting, the water-resistant pads 6 are compressed and are thus elastically deformed to completely seal the gaps therebetween and prevent humidity from invading from the surroundings into the box so that the liquid crystal glass panels are prevented from being damaged by humidity and the liquid crystal glass panels are well protected.

In the instant embodiment, the water-resistant pad 6 arranged between the first mounting section 231 and the first mounting slot 234 is of a configuration identical to that of the first mounting slot 234; the water-resistant pad 6 arranged between the second mounting section 233 and the second mounting slot 236 is of a configuration identical to that of the second mounting slot 236; the water-resistant pad 6 arranged between the third mounting section 252 and the third mounting slot is of a configuration identical to that of the third mounting slot; and the water-resistant pad 6 arranged between the fourth mounting section 254 and the fourth mounting slot is of a configuration identical to that of the fourth mounting slot, whereby the gaps therebetween can be completely sealed to provide an effective resistance against humidity.

The first mounting section 231 and the third mounting section 252 are of the same structure and size and the first mounting slot 234 and the third mounting slot are of the same structure and size. The second mounting section 233 and the fourth mounting section 254 are of the same structure and size. The second mounting slot 236 and the fourth mounting slot are of the same structure and size.

Each of the connection members 226 has an end forming a fifth mounting slot 272 and an opposite end forming a sixth mounting slot 274. The fifth mounting slot 272 is of the same structure and size as the first mounting slot 234 and the third mounting slot. The sixth mounting slot 274 is of the same structure and size as the second mounting slot 236 and the fourth mounting slot. The fifth mounting slot 272 functions to engage the first and third mounting sections 231, 252, while the sixth mounting slot 274 is for engaging the second and fourth mounting sections 233, 254 to thereby form the frame 22. Preferably, the first, second, third, and fourth mounting sections 231, 233, 252, 254 are fixedly retained in the first mounting slot 234, the second mounting slot 236, the third mounting slot, the fourth mounting slot, the fifth mounting slot 272, and the sixth mounting slot 274 through threading engagement, welding, or riveting.

The first frame member unit 230, the first coupler 232, the second frame member unit 250, the second coupler 251, and the connection member 226 are all made of plastic injection molding, wherein the first and second frame member units 230, 250 can be injection molded with the same mold. The first coupler 232 and the second coupler 251 can be injection molded with a same mold, whereby the expenditure cost of mold can be effectively reduced.

The bracket 4 comprises two first reinforcement plates 42, two second reinforcement plates 44, and a third reinforcement plate 46. The first and second reinforcement plates 42, 44 respectively correspond to the first and second frame members 222, 224 to show a linear configuration. The third reinforcement plate 46 is of a cruciform configuration. The first reinforcement plates 42 are mounted to an end of the first frame members 222 that is adjacent to the hollow plate 24. The second reinforcement plates 44 are mounted to an end of the second frame members 224 that is adjacent to the hollow plate 24. The third reinforcement plate 46 has four ends respectively mounted to middle portions of the ends of the two first reinforcement plates 222 and the two second reinforcement plates 224 that are adjacent to the hollow plate in order to support the frame members against deformation thereof caused by being compressed by external forces thereby preventing liquid crystal glass panels from being damage caused by being compressed by external forces.

The first reinforcement plates 42, the second reinforcement plates 44, and the third reinforcement plate 46 are all ferrous plates. The first reinforcement plates 42, the second reinforcement plates 44, and the third reinforcement plate 46 are connected to each other through riveting or threading engagement to form the bracket 4.

Figure 6:
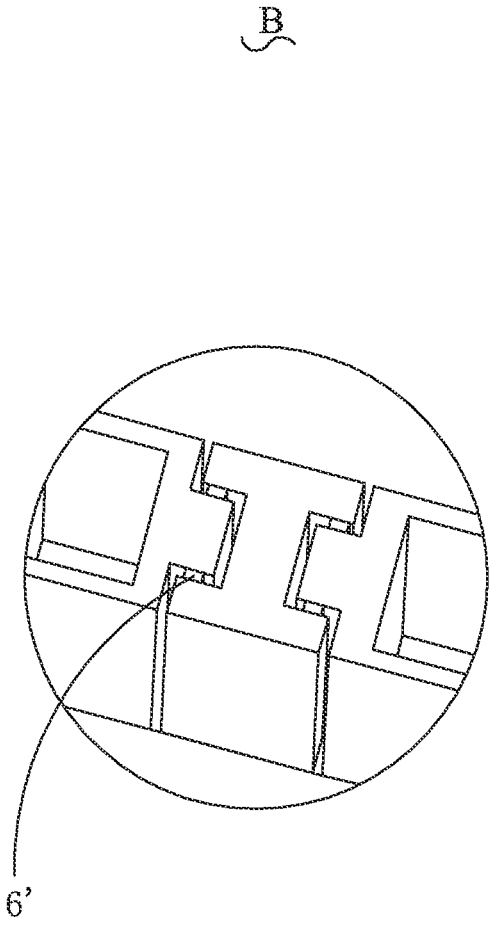
FIG. 6 is an enlarged view of circled portion B of FIG. 5.

Referring to FIGS. 5 and 6, which are schematic views showing a jointed liquid crystal glass panel package box according to another embodiment of the present invention, in the instant embodiment, the water-resistant pads 6' are of a plate like structure and are arranged, in group, between the first mounting section 231 and the first mounting slot 234, between the second mounting section 233 and the second mounting slot 236, between the third mounting section 252 and the third mounting slot, and between the fourth mounting section 254 and the fourth mounting slot to provide the same technical effect as that of the previous embodiment. Preferably, each group comprises two water-resistant pads 6' respectively set at two sides of the engagement between the first mounting section 231 and the first mounting slot 234, at two sides of the engagement between the second mounting section 233 and the second mounting slot 236, at two sides of the engagement between the third mounting section 252 and the third mounting slot, and at two sides of the engagement between the fourth mounting section 254 and the fourth mounting slot.

The water-resistant pads 6' are made of a soft material, such as rubber or silicon gel. When the first, second, third, and fourth mounting sections 231, 233, 252, 254 are mounted to the first mounting slot 234, the second mounting slot 236, the third mounting slot, and the fourth mounting slot with fastening or riveting, the water-resistant pads 6' are compressed and are thus elastically deformed to completely seal the gaps therebetween and prevent humidity from invading from the surroundings into the box so that the liquid crystal glass panels are prevented from being damaged by humidity and the liquid crystal glass panels are well protected.

In summary, the present invention provides a jointed liquid crystal glass panel package box, which comprises first and second frame members and connection members jointed to form a frame, of which the size is adjustable so as to be applicable to packaging of liquid crystal glass panels of different sizes. Water-resistant pads are arranged between the couplers and t connection units to provide an effective resistance against humidity. A hollow plate is provided as a bottom board to support the liquid crystal glass panels. A bracket is provided to improve the strength so as to prevent liquid crystal glass panels from damage caused by impacts of external forces. Further, the jointed liquid crystal glass panel package box of the present invention has a simple structure and a number of components can be manufactured with the same mold so as to effectively lower down the cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A jointed liquid crystal glass panel package box, comprising a box body and a plurality of brackets mounted to the box body, the box body comprising a frame and a hollow plate arranged inside the frame, the frame comprising two opposite first frame members, two opposite second frame members, and four L-shaped connection members connecting between the first frame members and the second frame members, the first and second frame members being of a linear configuration, each of the first frame members comprising a plurality of first frame member units and a plurality of first couplers each connecting between two first frame member units, each of the second frame members comprising a plurality of second frame member units and a plurality of second couplers each connecting between two second frame member units, a plurality of water-resistant pads being arranged between the first couplers and the first frame member units and between the second couplers and the second frame member units;

wherein each of the first frame member units has one end forming a first mounting section and an opposite end forming a second mounting section, each of the second frame member units having an end forming a third mounting section and an opposite end forming a fourth mounting section, the first coupler having an end forming a first mounting slot and an opposite end forming a second mounting slot, the first mounting section being received and retained in the first mounting slot and the second mounting section being received and retained in the second mounting slot to form the first frame member, the two ends of the first frame member being respectively a first mounting section and a second mounting section, the second coupler having an end forming a third mounting slot and an opposite end forming a fourth mounting slot, the third mounting section being received and retained in the third mounting slot and the fourth mounting section being received and retained in the fourth mounting slot to form the second frame member, the two ends of the second frame member being respectively a third mounting section and a fourth mounting section;

wherein the plurality of water-resistant pads are arranged between the first mounting sections and the first mounting slots, between the second mounting sections and the second mounting slots, between the third mounting sections and the third mounting slots, and between the fourth mounting sections and the fourth mounting slots without projecting beyond the first frame member units, the second frame member units, and the first and second couplers; and wherein the bracket comprises two first reinforcement plates and two second reinforcement plates, the first and second reinforcement plates having linear configurations that are respectively corresponding to and substantially coextensive with and mounted to the first and second frame members.

2. The jointed liquid crystal glass panel package box as claimed in claim 1, wherein the water-resistant pad arranged between the first mounting section and the first mounting slot is of a configuration identical to that of the first mounting slot; the water-resistant pad arranged between the second mounting section and the second mounting slot is of a configuration identical to that of the second mounting slot; the water-resistant pad arranged between the third mounting section and the third mounting slot is of a configuration identical to that of the third mounting slot; and the water-resistant pad arranged between the fourth mounting section and the fourth mounting slot is of a configuration identical to that of the fourth mounting slot.

3. The jointed liquid crystal glass panel package box as claimed in claim 1, wherein the first mounting section and the third mounting section are of the same structure and size and the first mounting slot and the third mounting slot are of the same structure and size, the second mounting section and the fourth mounting section being of the same structure and size, the second mounting slot and the fourth mounting slot being of the same structure and size.

4. The jointed liquid crystal glass panel package box as claimed in claim 3, wherein each of the connection members has an end forming a fifth mounting slot and an opposite end forming a sixth mounting slot, the fifth mounting slot being of the same structure and size as the first mounting slot and the third mounting slot, the sixth mounting slot being of the same structure and size as the second mounting slot and the fourth mounting slot, the fifth mounting slot being provided for selective engagement with the first and third mounting sections, the sixth mounting slot being provided for engagement with the second and fourth mounting sections to thereby form the frame.

5. The jointed liquid crystal glass panel package box as claimed in claim 1, wherein the first frame member units, the first coupler, the second frame member units, the second coupler, and the connection members are made of plastic injection molding, the water-resistant pads being made of rubber or silicon gel.

6. The jointed liquid crystal glass panel package box as claimed in claim 1, wherein the bracket further comprises a third reinforcement plate, which has a cruciform configuration comprising a first elongate section that is substantially parallel to the first reinforcement plates and a second elongate section that is substantially parallel to the second reinforcement plates, the second elongate section of the third reinforcement plate having ends respectively mounted to the first reinforcement plates and the first elongate section of the third reinforcement plate having ends respectively mounted to the second reinforcement plates.

7. The jointed liquid crystal glass panel package box as claimed in claim 6, wherein the first reinforcement plates, the second reinforcement plates, and the third reinforcement plate are all ferrous plates, the first reinforcement plates, the second reinforcement plates, and the third reinforcement plate being connected to each other through riveting or threading engagement to form the bracket.

8. A jointed liquid crystal glass panel package box, comprising a box body and a plurality of brackets mounted to the box body, the box body comprising a frame and a hollow plate arranged inside the frame, the frame comprising two opposite first frame members, two opposite second frame members, and four L-shaped connection members connecting between the first frame members and the second frame members, the first and second frame members being of a linear configuration, each of the first frame members comprising a plurality of first frame member units and a plurality of first couplers each connecting between two first frame member units, each of the second frame members comprising a plurality of second frame member units and a plurality of second couplers each connecting between two second frame member units, a plurality of water-resistant pads being arranged between the first couplers and the first frame member units and between the second couplers and the second frame member units;

wherein each of the first frame member units has one end forming a first mounting section and an opposite end forming a second mounting section, each of the second frame member units having an end forming a third mounting section and an opposite end forming a fourth mounting section, the first coupler having an end forming a first mounting slot and an opposite end forming a second mounting slot, the first mounting section being received and retained in the first mounting slot and the second mounting section being received and retained in the second mounting slot to form the first frame member, the two ends of the first frame member being respectively a first mounting section and a second mounting section, the second coupler having an end forming a third mounting slot and an opposite end forming a fourth mounting slot, the third mounting section being received and retained in the third mounting slot and the fourth mounting section being received and retained in the fourth mounting slot to form the second frame member, the two ends of the second frame member being respectively a third mounting section and a fourth mounting section;

wherein the plurality of water-resistant pads are arranged between the first mounting sections and the first mounting slots, between the second mounting sections and the second mounting slots, between the third mounting sections and the third mounting slots, and between the fourth mounting sections and the fourth mounting slots without projecting beyond the first frame member units, the second frame member units, and the first and second couplers;

wherein the water-resistant pad arranged between the first mounting section and the first mounting slot is of a configuration identical to that of the first mounting slot; the water-resistant pad arranged between the second mounting section and the second mounting slot is of a configuration identical to that of the second mounting slot; the water-resistant pad arranged between the third mounting section and the third mounting slot is of a configuration identical to that of the third mounting slot; and the water-resistant pad arranged between the fourth mounting section and the fourth mounting slot is of a configuration identical to that of the fourth mounting slot;

wherein the first mounting section and the third mounting section are of the same structure and size and the first mounting slot and the third mounting slot are of the same structure and size, the second mounting section and the fourth mounting section being of the same structure and size, the second mounting slot and the fourth mounting slot being of the same structure and size;

wherein each of the connection members has an end forming a fifth mounting slot and an opposite end forming a sixth mounting slot, the fifth mounting slot being of the same structure and size as the first mounting slot and the third mounting slot, the sixth mounting slot being of the same structure and size as the second mounting slot and the fourth mounting slot, the fifth mounting slot being provided for selective engagement with the first and third mounting sections, the sixth mounting slot being provided for engagement with the second and fourth mounting sections to thereby form the frame;

wherein the first frame member units, the first coupler, the second frame member units, the second coupler, and the connection members are made of plastic injection molding, the water-resistant pads being made of rubber or silicon gel;

wherein the bracket comprises two first reinforcement plates and two second reinforcement plates, the first and second reinforcement plates having linear configurations that are respectively corresponding to and substantially coextensive with and mounted to the first and second frame members;

wherein the bracket further comprises a third reinforcement plate, which has a cruciform configuration comprising a first elongate section that is substantially parallel to the first reinforcement plates and a second elongate section that is substantially parallel to the second reinforcement plates, the second elongate section of the third reinforcement plate having ends respectively mounted to the first reinforcement plates and the first elongate section of the third reinforcement plate having ends respectively mounted to the second reinforcement plates; and wherein the first reinforcement plates, the second reinforcement plates, and the third reinforcement plate are all ferrous plates, the first reinforcement plates, the second reinforcement plates, and the third reinforcement plate being connected to each other through riveting or threading engagement to form the bracket.

* * * * *